United States Patent [19]

Pardo

[11] Patent Number: 4,798,036

[45] **Date of Patent: * Jan. 17, 1989**

[54] CONCRETE MASONRY FOOTER BLOCK FOUNDATION SYSTEM AND BLOCKS THEREFOR

[75] Inventor: Jorge Pardo, Reston, Va.

[73] Assignee: National Concrete Masonry Association, Herndon, Va.

[ * ] Notice: The portion of the term of this patent subsequent to Nov. 3, 2004 has been disclaimed.

[21] Appl. No.: 71,021

[22] Filed: Jul. 8, 1987

Related U.S. Application Data

[63] Continuation of Ser. No. 771,607, Sep. 3, 1985, abandoned.

[51] Int. Cl.[4] ..... E02D 27/32

[52] U.S. Cl. ..... 52/293; 52/294; 52/590; 52/604; 52/609

[58] Field of Search ..... 52/292, 293, 590, 596, 52/604, 605, 609

[56] References Cited

U.S. PATENT DOCUMENTS

| | | | |
|---|---|---|---|
| 543,582 | 7/1895 | Meyenberg | 52/590 |
| 738,643 | 9/1903 | Van Camp | 52/605 |
| 989,467 | 4/1911 | Vengst | 52/589 |
| 1,565,959 | 12/1925 | Requa | 52/293 |
| 2,058,285 | 10/1936 | Amescug | 52/262 |
| 2,126,011 | 8/1938 | Hedinger | 52/593 |
| 2,126,012 | 8/1938 | Hedinger | 52/286 |
| 2,176,805 | 10/1939 | Scheible | 52/605 |
| 2,695,159 | 11/1954 | Bridwell | 52/293 |
| 2,727,382 | 12/1955 | Kurz | 52/98 |
| 3,305,982 | 2/1967 | Steele | 52/292 |
| 3,354,592 | 11/1967 | Curci | 52/98 |
| 3,945,747 | 3/1976 | Cruz | 52/596 |
| 4,069,633 | 1/1978 | Cooper et al. | 52/596 |
| 4,123,881 | 11/1978 | Muse | 52/100 |

FOREIGN PATENT DOCUMENTS

| | | | |
|---|---|---|---|
| 807017 | 7/1944 | Fed. Rep. of Germany . | |
| 1112822 | 8/1961 | Fed. Rep. of Germany . | |
| 58327 | 11/1953 | France . | |
| 1567155 | 5/1980 | United Kingdom | 52/605 |

OTHER PUBLICATIONS

"Leca Foundation Block", publication A/S Norsk Leca.

*Primary Examiner*—David A. Scherbel
*Assistant Examiner*—Caroline D. Dennison
*Attorney, Agent, or Firm*—Lowe, Price, LeBlanc, Becker & Shur

[57] ABSTRACT

A footing or foundation system for a wall or like structure is provided comprising a plurality of concrete masonry ("CM") footing blocks disposed in abutting relationship along a foundation axis extending substantially parallel to the longitudinal axis of the wall to be supported on such footing blocks. The footing stretcher blocks have a lateral dimension which extends substantially perpendicular to the axis of the foundation and is substantially longer than the longitudinal dimension of such blocks which extends substantially parallel to the foundation axis. The lateral dimensions of the CM footing blocks are nominal multiples of the longitudinal dimension of such blocks; and the lateral dimension of such blocks is preferably at least four times the longitudinal dimension of such blocks. The vertical dimension of such CM footer stretcher blocks is substantially larger than its longitudinal dimension, and preferably at least twice as large; however, the vertical dimension of such blocks is significantly less than the lateral block dimensions which are preferably at least twice the vertical dimension of the blocks. The CM footing blocks have protrusions and depressions in the abutting sides thereof to provide lateral interlocking. The CM block footing or foundation system also comprises CM corner or pilaster blocks having a substantially rectangular shape and including protrusions and depressions for mating with protrusions and depressions on abutting CM footing stretcher blocks. Such CM footing stretcher and corner blocks can be made in a conventional CM casting machine with suitably modified molds and at a fast production rate.

16 Claims, 3 Drawing Sheets

CONCRETE MASONRY FOOTER BLOCK FOUNDATION SYSTEM AND BLOCKS THEREFOR

This is a continuation of application Ser. No. 771,607, filed Sept. 3, 1985, now abandoned.

BACKGROUND OF THE INVENTION

This invention relates to masonry wall and building construction and more particularly relates to an improved prefabricated footing system and an improved concrete masonry footing block.

The footings for masonry structures and particularly for masonry housing are conventionally prepared by digging trenches in accordance with the layout of the house, forming frameworks for the footing in the trenches and pouring concrete in the space formed by the framing so as to form a continuous footing. Relatively recently prefabricated concrete footing blocks have been utilized. Foundations formed in this manner generally involve the placement in the foundation trenches of the required number of precast footing blocks which are leveled and supported directly on the ground or by means of a sub-base or substrate of gravel or any other suitable material. The prefabricated footing blocks which have been proposed heretofore have generally been of an elongated shape and these have been disposed horizontally in an end-to-end fashion along their major axes to serve as a footing for masonry wall mounted thereon with the major axes of the footing blocks extending in the same direction as the longitudinal axes of the wall.

Blocks of this general type are illustrated by way of example in Canadian Patent No. 1,077,281 issued May 13, 1980. These particular blocks are formed of precast concrete with an inverted T cross section and are provided with a plurality of bores in the widened base to permit the pouring of concrete or mortar to minimize the difficulties which had previously been encountered in laying a uniform and adequately anchored footing of prefabricated blocks. Another example of prefabricated footing or foundation blocks is illustrated in U.S. Pat. No. 894,122 issued July 21, 1908. The blocks shown in that patent are of a curved elongated form and show a masonry construction for a circular grain bin.

Probably the most analogous prior commercial prefabricated footing blocks are the "Leca Foundation Block" made by A/S Norsk Leca of Norway. The Leca system is based on a concrete masonry footing block unit which is 20 inches (50 cm) long, 12 inches (33 cm) wide and 6 inches (17 cm) thick. The Leca footing blocks are installed with the block's longest axis extending in the direction of the wall, and the blocks are interlocked at their ends without mortar.

While prefabricated footings of these prior types provide certain advantages over poured concrete footings, they have thus far also presented certain problems and disadvantages. The prefabricated blocks are generally relatively heavy (over 50 pounds, for example) and present certain difficulties in transportation and handling. The weight of the blocks and the type of handling which is necessitated tends to cause the workmen to tire and can result in higher costs and/or flawed footings and surmounting walls due to imprecise placement of the blocks as the workers tire. Further, the maximum weight of block that may be readily handled manually by workmen imposes a practical limit on the width of the footing and therefore its utility for use in poor soil conditions. A still further disadvantage in the known prefabricated footing blocks proposed to date is their limitation to use with walls of predetermined types and dimensions and their lack of adaptation to the varied foundations and wall structures generally found to be desirable in building construction.

SUMMARY OF THE INVENTION

It is an object of the present invention to provide an improved prefabricated concrete masonry ("CM") block footing system which eliminates or minimizes the problems previously encountered with systems of this general type and in particular problems resulting from the weight and handling of the footing blocks and uniform support therefor.

It is another object of the invention to provide an improved prefabricated concrete masonry block footing system which permits the use of footings having a sufficient width to be practical in relatively poor soil conditions.

It is another object of the invention to provide an improved prefabricated concrete masonry block footing system wherein the CM blocks are modular in form and suited to use in building construction of varying shapes, sizes and configurations so as to permit a high degree of architectural and engineering flexibility.

It is still another object of the invention to provide an improved concrete masonry block footing system utilizing CM blocks which are relatively simple in shape and economical to produce and transport.

It is another object of the invention to provide a footing system for masonry structures comprising a plurality of CM footing blocks disposed in abutting relationship along a footing axis substantially parallel to the plane of the structure to be supported with such footing blocks having protrusions and depressions in the abutting ends thereof to provide a lateral interlocking, and having lateral dimensions substantially perpendicular to the footing axis and longitudinal dimensions along such axis wherein the lateral dimensions are substantially larger than the longitudinal dimensions.

It is still a further object of the invention to provide a prefabricated CM footing block for masonry structures comprising a concrete masonry block having a bottom surface for engagement with a horizontal foundation substrate and a top surface for supporting said structure on said foundation substrate wherein said top and bottom surfaces have at least major portions thereof disposed in substantially parallel planes, with the CM block having a longitudinal axis substantially parallel to said planes and passing through the centroid of said CM block and having a transverse axis substantially parallel to said planes and passing through the centroid of said CM block substantially perpendicular to said longitudinal axis, where the block has a dimension on the transverse axis substantially greater than its dimension on the longitudinal axis, and has end surfaces at opposite ends thereof with at least a major portion of each end surface substantially parallel to the transverse axis, and with the end surfaces at each of said opposite ends having first portions thereof disposed in planes substantially parallel to the transverse axis located at a first distance from the transverse axis and having second portions thereof disposed in planes substantially parallel to the transverse axis located at a second distance from the transverse axis wherein said first and second distances are different and the end surfaces include portions joining said first and second portions of said end surfaces.

Briefly described, the present invention comprises a prefabricated concrete masonry block footing system for supporting masonry wall and the like structures wherein the CM footing blocks are of a generally oblong shape with the long or main axis of the block disposed substantially perpendicular to the plane of the wall and the axis of the footing. Adjacent CM footing blocks abut and interface along their long sides in contrast to prior construction wherein precast footing blocks generally were disposed in an end-to-end relationship.

The interfacing surfaces of the concrete masonry ("CM") blocks formed according to the invention are provided with mating protrusions and depressions to maximize lateral strength and stability in the footing. This shape and disposition of the prefabricated CM blocks in the footing according to the system of the invention permits forming footings of a relatively wide lateral dimension to cope with poor soil conditions while at the same time keeping the weight of the individual CM blocks relatively low to permit efficient manual handling. Simultaneous with the foregoing advantage, the footing system of the invention permits the footing to conform to the inevitable unevenness of the substrate foundation by virtue of the ability of the prefabricated footing blocks of relatively limited longitudinal dimension to settle into firm support engagement with such substrate. This eliminates a large degree of the uneven support encountered with the older oblong end-to-end blocks wherein the blocks tended to be supported at spaced prominences in the substrate thereby imposing stresses which frequently resulted in breakage in the footing and weakening if not cracking in the supported wall.

According to the preferred embodiment of the invention, the prefabricated CM footing blocks are provided in modular form having a horizontal cross section comprised of a plurality of nominal squares offset with respect to one another to provide the protrusions and depressions for interlocking engagement between adjacent blocks. The blocks may be provided in a variety of sizes which are multiples of the module to thereby permit an architectural and engineering flexibility not previously possible with footings of a prefabricated type.

Corner or pilaster CM blocks are provided which also are modular in construction and have a generally rectangular horizontal cross section with protrusions and depressions on all four sides thereof so as to mate with stretcher blocks extending from the corners in any or all of four directions. According to a preferred embodiment of the invention, the dimensions of the depressions and protrusions on the CM corner blocks are related to the mating depressions and protrusions on the stretcher blocks in such a manner as to provide vertical access openings at the interfaces to receive vertical reinforcing rods should such reinforcement be necessary or desirable.

Other objects, features and advantages of the present invention will become apparent upon reading the following specification and claims when taken in conjunction with the accompanying drawings.

DETAILED DESCRIPTION

Figure 1:
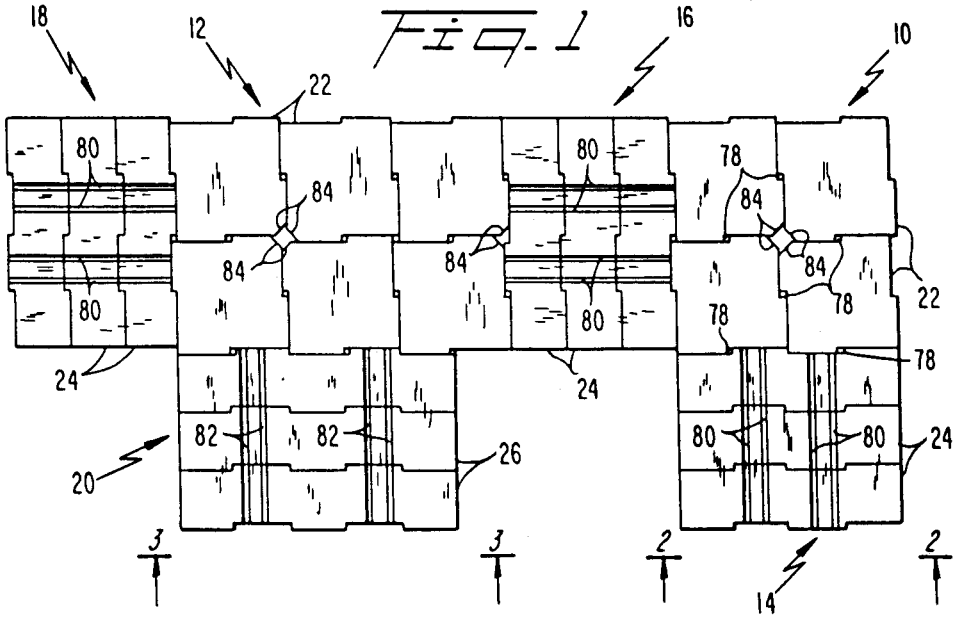
FIG. 1 is a plan view of an illustrative portion of a footing for a building structure formed with the prefabricated CM block footing system of the invention.

Referring now in more detail to the drawings in which like numerals and letters indicate like parts and dimensions throughout the several views, FIG. 1 illustrates in plan view a portion of a building footing which includes a CM corner or pilaster indicated generally at 10, an interwall CM corner or pilaster generally indicated at 12 and CM wall footings generally indicated at 14, 16, 18 and 20. The CM corners or pilasters 10 and 12 are formed from CM corner blocks 22, while the walls 14, 16, 18 and 20 are formed from CM wall blocks or stretchers 24 and 26. The CM stretchers 26 are of a greater width than the stretchers 24 as will presently be described in further detail The CM footing blocks 22 through 26 are disposed in the conventional footing trenches either directly on the soil or on any conventional footing bed as desired. The space between the sides of the blocks and the sides of the trenches is ultimately filled with earth or other suitable filler.

Figure 5:
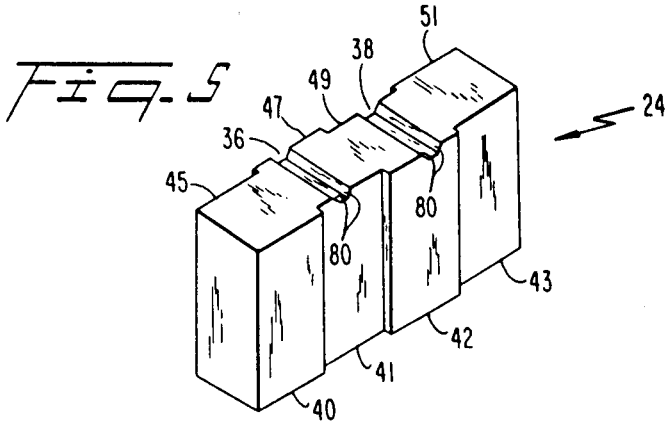
FIG. 5 is an isometric view of the one of the prefabricated CM footing blocks constructed according to the invention utilized in the rightmost footing in FIGS. 1 and 2.
Figure 6:
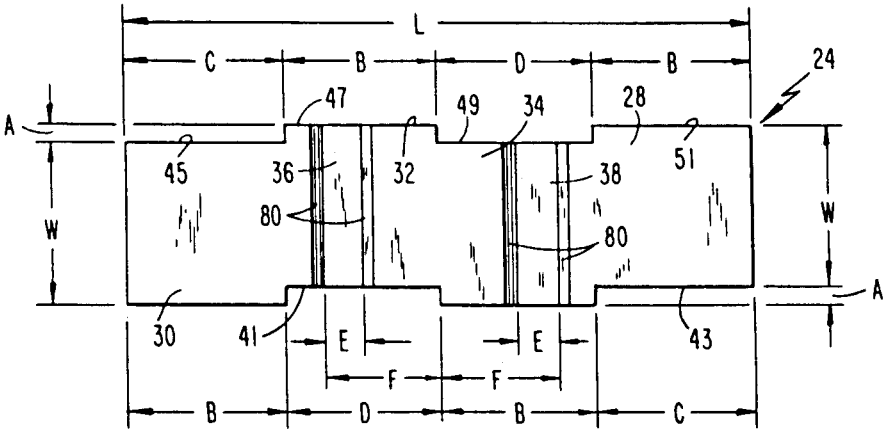
FIG. 6 is a plan view of the CM footing block of FIG. 5.
Figure 7:
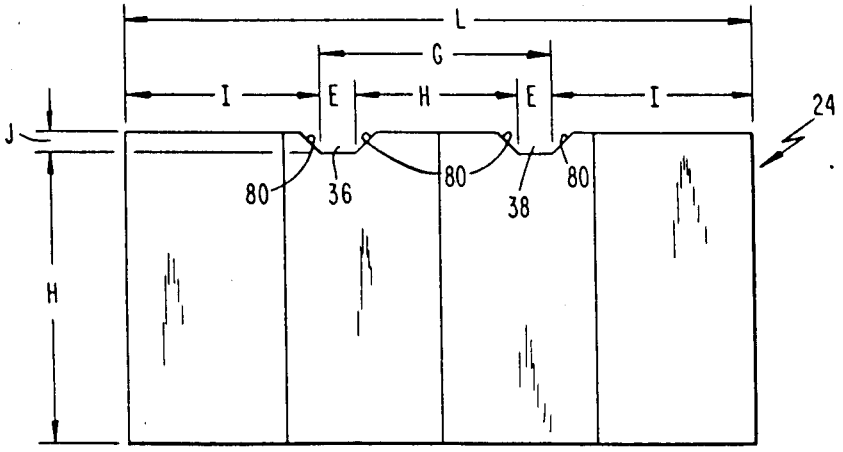
FIG. 7 is a side elevation of the CM footing block of FIGS. 5 and 6.

Referring to FIGS. 5, 6 and 7 which illustrate the details of the stretchers 24, it will be seen that these stretchers or blocks have a long dimension or length L (see FIGS. 6 and 7) which extends in a direction transverse or perpendicular to the axis of the footing 14 and perpendicular to the plane of the wall which is supported by that footing. The width W of the block (see FIG. 6) which extends longitudinally along the axis of the footing 14 and along or parallel to the plane of the wall supported by footing 14 is relatively small in relation to the transverse length L. According to the preferred embodiment of the invention, the longitudinal dimension W of the block is nominally a sub-multiple of its transverse dimension L. The vertical height H of the block (FIG. 7) is also less than the transverse length L of the block but greater than the longitudinal width W.

The footing block or stretcher 24 is comprised of end modules 28 and 30 and intermediate modules 32 and 34 which are preferably nominally equal squares in plan view as seen in FIG. 6. Generally rectangular grooves 36 and 38 are provided in the upper surfaces of the intermediate modules 32 and 34 for a purpose presently to be described.

Referring to FIG. 6, adjacent modules are displaced from one another along the short dimension W of the block by a distance indicated at A in FIG. 6. This offset provides protrusions and depressions 40, 41, 42 and 43 on one face of the block 24 and converse depressions and protrusions 45, 47, 49 and 51 on the opposite face of the block as seen in FIG. 5. These protrusions and depressions provide a lateral interlock between adjacent blocks or stretchers 24 when assembled into a footing such as the footing 14 in FIG. 1.

While the plan view shape of the modules 28, 30, 32 and 34 in FIG. 6 has been described as nominally equal squares, it is preferred to provide design deviations from a true square shape in order to achieve the desired mating relationship with adjacent blocks. To this end the dimension B of the protrusions 47 and 51 on the upper surfaces of modules 28 and 32 in FIG. 6 is slightly less than the dimension C of the depressions 43 and 45 and still less than the dimension D of the depressions 41 and 49 whereby a mating fit between the protrusions and depressions is assured. The dimension D of depressions 41 and 49 is slightly greater than the dimension C of the end depressions 43 and 45 because it is necessary to provide clearance only on one side of the protrusion at the end of the block.

The grooves 36 and 38 are preferably of equal width E (FIGS. 6 and 7) and the outermost edges thereof are spaced equal distances F from the centerline of the block 24 as may be seen in FIG. 6. The distance G between the outer edges of the grooves 36 and 38 in FIG. 7 is thus twice the distance F. The distance between the inner edges of the grooves 36 and 38 is indicated at H in FIG. 7, and the distance between the outer edges of the groove and the adjacent edges of the block is indicated at I. The depth of the grooves is indicated at J in FIG. 7.

The grooves or slots 36 and 38 of footing block 24 are provided with chamfered edges 80 disposed at an angle of about 45° ± about 10° with respect to the adjacent face surfaces and sides of footing block 24. The angle formed by such chamfers permits stripping of blocks 24 from the mold of a CM casting machine without damaging the ends of block grooves 26 and 38. Such angles provided by chamfered edges 80 help break the vacuum to facilitate stripping the molded block 24 from the CM casting machine, and such angles enable keeping clean the slot-forming bars on the stripper head of the CM casting machine.

Figure 8:
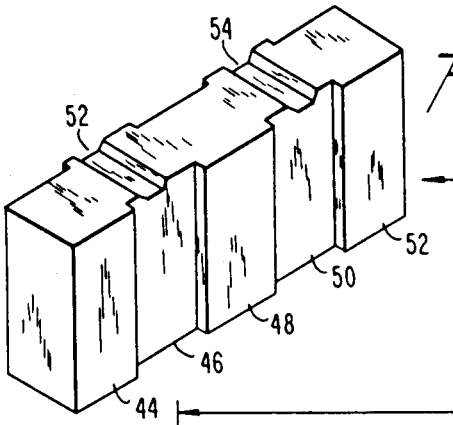
FIG. 8 is an isometric view of one of the prefabricated CM footing blocks constructed according to the invention and utilized in the leftmost footing of FIGS. 1 and 3.
Figure 9:
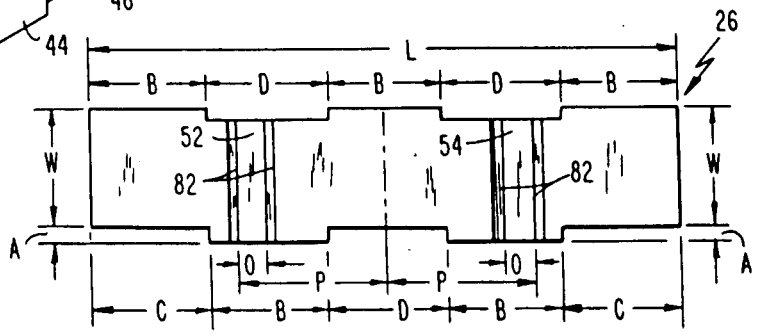
FIG. 9 is a plan view of the CM footing block of FIG. 8.
Figure 10:
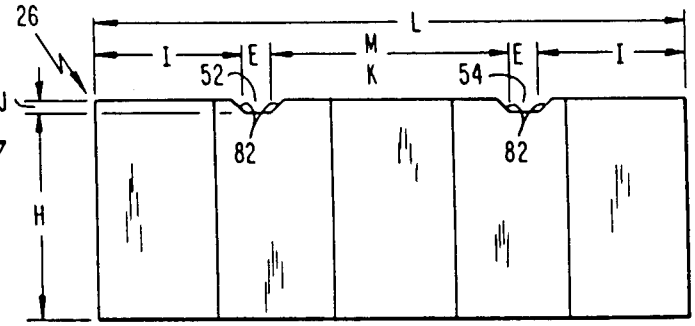
FIG. 10 is a side elevation view of the CM footing block of FIGS. 8 and 9.

Referring to FIGS. 8, 9 and 10 there are illustrated details of the stretcher blocks 26 used in the left wall 20 in FIG. 1. The blocks 26 are constructed with five modules, as contrasted to the four modules used in blocks 24 utilized in the rightmost wall 14 and described in detail in connection with FIGS. 5, 6 and 7. Thus referring to FIG. 8, the blocks 26 are, from left to right, comprised of modules 44, 46, 48, 50 and 52. Comparing the block 26 in FIG. 8 with block 24 in FIG. 5 it will be seen that the leftmost modules 44, 46, 48 and 50 of block 26 in FIG. 8 are identical to modules 30, 32, 34 and 28 of the block 24 in FIGS. 5 and 6.

Thus in accordance with the modular system that is a feature of the invention, the four-module block of FIGS. 5, 6 and 7 is expanded to the five-module block in FIGS. 8, 9 and 10 by the addition of the rightmost module 52 following the principle of offsetting adjacent modules by the distance A as described in connection with the block 24 illustrated in FIGS. 5, 6 and 7. Accordingly, it will be found that the dimensional reference letters applied in FIGS. 9 and 10 correspond to those found in FIGS. 6 and 7. The width and depth of the grooves 52 and 54 in the block 26 in FIGS. 8, 9 and 10 is the same as the width and depth of the grooves 36 and 38 in the block 24 in FIGS. 5, 6 and 7 and is so indicated by similar reference letters. The outermost edges of the grooves 52 and 54 in FIGS. 8, 9 and 10 are disposed the same distance I from the outer face of the block 26 as are the outermost edges of the grooves 36 and 38 from the edges of the block 24 and these are so indicated by the same reference letter I. However, since the overall dimension L of the block 26 is greater than that of the block 24, the spacing between the innermost and outermost edges of the grooves 52 and 54 from one another is different and is indicated at K and M in FIG. 10.

The grooves or slots 52 and 54 of footing block 26 are provided with chamfered edges 82 disposed at an angle of about 45° ± about 10° with respect to the adjacent face surfaces and sides of footing block 24. The angle formed by such chamfers provides like advantageous functions as discussed above with reference to chamfers 80 of footing block 24.

Figure 2:
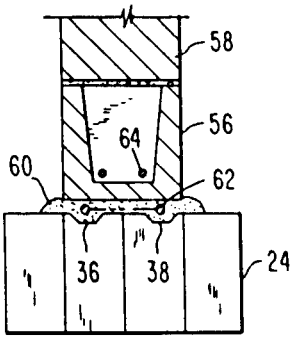
FIG. 2 is a side elevation view of the rightmost CM block footing of FIG. 1 (taken along line 2—2 in FIG. 1) showing in partial section exemplary concrete masonry wall building blocks mounted on such footing.
Figure 3:
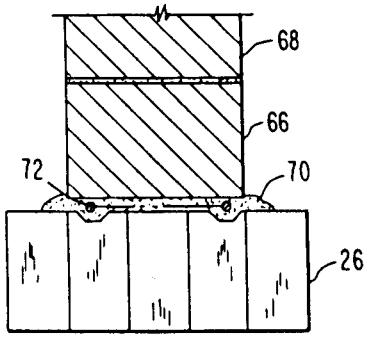
FIG. 3 is a side elevation view of the leftmost CM block footing of FIG. 1 (taken along line 3—3 in FIG. 1) showing in partial section exemplary wall building blocks mounted on such footing.

The blocks or stretchers of FIGS. 5–7 and FIGS. 8–10 are assembled to support masonry walls in the manner shown in FIGS. 1, 2 and 3. Thus referring to FIG. 2, the blocks 24 in the rightmost wall 14 support masonry (concrete or the like) blocks 56 and 58 on a suitable mortar bed 60 which is locked into the grooves 36 and 38. If desired, reinforcement may be provided as by conventional steel reinforcing grids indicated at 62 imbedded in the mortar 60. Similarly, extra reinforcement 64 may be provided in recessed blocks 56 where deemed necessary or desirable. The masonry wall blocks shown in section at 56 and 58 in FIG. 2 extend along the longitudinal axis of the footing and along the plane of the wall across the upper surfaces of multiple stretchers or footing blocks 24.

Referring to FIG. 3, the leftmost wall 20 is shown formed of blocks or stretchers 26 supporting concrete or masonry blocks 66 and 68 on a mortar bed 70 in which reinforcement members or grids 72 may be provided if desired. The stretchers 24 and 26 may be provided in sizes dimensioned to support the design wall load in the specific foundation or soil conditions which are encountered. According to an illustrative example, such blocks or stretchers may be provided having the following dimensions:

BLOCK 24

Nominal Dimensions = 16×4×8 inches
- Actual L = 15 15/16 inches
- Actual W = 3 31/32 inches
- Actual H = 8 inches
- Actual A = ⅜ inches
- Actual B = 3 15/16 inches
- Actual C = 4 inches
- Actual D = 4 1/16 inches
- Actual E = 1 inch
- Actual F = 3 inches Actual G =6 inches
Actual H =4 inches
Actual I =4 31/32 inches
Actual J =½ inch

BLOCK 26

Nominal Dimensions =20×4×8 inches
Actual L =19 5/16 inches
Actual W =3 31/32 inches
Actual H =8 inches
Actual A =⅜ inches
Actual B =3 15/16 inches
Actual C =4 inches
Actual D =4 1/16 inches
Actual E =1 inch
Actual I =4 31/32 inches
Actual J =½ inch
Actual K =8 inches
Actual M =10 inches
Actual 0 =4 inches
Actual P =5 inches The lateral and vertical dimension of each chamfer 80 in block 24 and of each chamfer 82 in block 26 is about ¼ inch.

Certain relationships between the outside dimensions of the footing blocks or stretchers are desirable in order to obtain the maximum advantages of the invention. Thus it is a feature of the invention that the length L of the stretcher block should be significantly greater than its width W and preferably no less than substantially four times the width W. The height H of the stretcher block should be significantly greater than the width W and preferably no less than substantially twice the width W. The length L of the stretcher block should be significantly greater than the height H of the stretcher block and preferably no less than substantially twice the height H. The length along the wall plane of the concrete or masonry wall block supported by the footing formed by the stretcher blocks should be significantly greater than the width W of the stretcher blocks and preferably at least substantially four times the width W.

Stretcher blocks constructed according to the foregoing may be provided in unit weights which are much lower than those which were practically feasible with prior precast footing blocks and make it possible to provide footings of precast blocks which are sufficiently wide to be useful in poor soil conditions. This was not possible with the older footing blocks because the weight of blocks which were wide enough to provide the necessary support under such conditions made manual handling impractical. When utilizing the modular and staggered block structure of the invention the lateral strength of the footing increases with its lateral width as additional protrusions and depressions provide added interlock strength.

Figure 4:
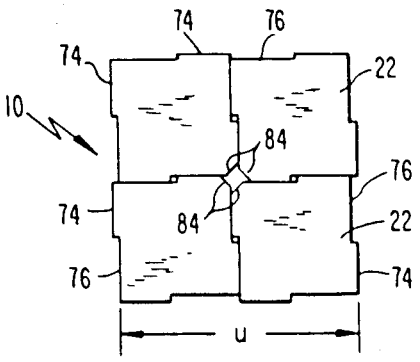
FIG. 4 is a plan view of the right corner column or pilaster of the footing of FIG. 1.
Figure 11:
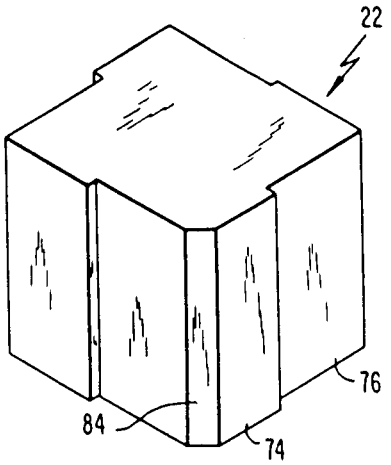
FIG. 11 is an isometric view of one of the CM corner footing blocks constructed according to the invention and utilized in the corner and interwall pilaster of FIG. 1.
Figure 12:
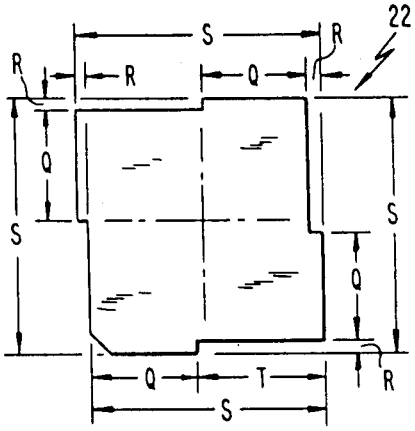
FIG. 12 is a plan view of the corner block of FIG. 11.

Referring to the upper right corner of FIG. 1 and to FIG. 4 there is seen a corner or pilaster 10 formed from CM corner blocks 22. Corner blocks 22 are illustrated in detail in FIGS. 11 and 12. The corner blocks 22 are constructed in accord with the modular system of the invention and constitute two nominal modules on a side for a total of four modules in the block. Each vertical face of each corner block comprises a protrusion 74 adjoining a depression 76. Each protrusion 74 has a width indicated at Q in FIG. 12 and each depression is offset downwardly therefrom by the distance R in FIG. 12. The total actual overall dimension of each side of the corner block is indicated at S in FIG. 12.

Referring to FIGS. 1 and 4, the length U (FIG. 4) of the vertical face of two abutted corner blocks is equal to twice S which is equal to the total length L of the side of the adjoining stretcher 24. However, the dimension Q of the face of a protrusion on a corner block is less than the dimension B of a protrusion on a stretcher block 24, and the dimension T of a depression in the corner block is thus greater than the dimension C or D of a depression in an adjacent stretcher block 24. The differences in dimension between a protrusion Q on the corner block and depression C or D on the adjacent stretcher block are greater than that required for clearance. These dimensional differences are designed to provide vertical openings 78 shown in FIG. 1 which may be utilized as a passageway for vertical reinforcing rods extending through the footings into the foundation an upwardly into the overlying first course of the masonry wall if desired. The height of the corner blocks is of course equal to the height of the adjoining stretcher blocks. An illustrative example of the dimensions of suitable corner blocks is as follows:

CORNER BLOCK 22

Nominal Dimensions =8×8×8 inches
Actual Q =3⅝ inches
Actual R =⅜ inches
Actual S =7 31/32 inches
Actual T =4 11/32 inches
Actual U =15 15/16 inches
Actual H =8 inches One vertical edge of corner block 22 is provided with a chamfered edge 84 disposed at an angle of about 45° ±10° with respect to the adjacent side surfaces of corner block 22. The lateral dimension of each chamfer 84 on each side of block 22 is about ½ inch. The chamfers 84 of footing blocks 22 are disposed in assembled relationship as shown in FIG. 1; this provides spacing for application of grout therein.

Referring again to FIG. 1, the leftmost corner or pilaster 12 is formed of six corner blocks 22 to interface with the 20-inch stretchers 26 in the wall 20. The invention comprehends the use of stretchers which may be longer than the 16 and 20-inch blocks shown. Such longer stretchers may be provided in additional four-inch increments by repetition of the modular system illustrated in the 16 and 20-inch blocks 24 and 26. Thus, referring to the plan view of the blocks 26 in FIG. 1, an additional four-inch leftward module would include a protrusion on its upper surface and a depression on its lower surface. Still another module would constitute the converse or a depression on its upper surface and a protrusion on its lower surface. Pilasters to accommodate such longer stretchers may be provided through the use of additional corner blocks as will be evident from FIG. 1.

In the building construction industry, the term "concrete masonry block" (also herein called "CM block") refers to a block made with a concrete cementitious material averaging about 100 lbs/cu.ft. density or more and made of such a size and weight so that the CM block can be handled at the construction site by a single mason or laborer for use in construction of CM block footings like 14, 16 and 18 and also for making CM block corners or pilasters 10 and 12 according to the embodiments of FIGS. 1–12. Further, in commercial practice a concrete masonry block must be makeable in a conventional commercially available CM block casting machine with a suitably modified mold. Still further, to be commercially competitive, CM blocks must be made in such equipment at the rate of one CM block every 5–6 seconds (or preferably faster). It is noted that from technical, practical and commercial viewpoints, CM blocks are different in kind from precast concrete footings with respect to various factors such as size, method of manufacture, curing time, manner of installation, etc. Using good current practice, the CM footing or stretcher blocks 14 and 16 and the CM corner or pilaster blocks 22 shown in the drawings hereof and described herein would be made with such concrete cementitious material according to the foregoing.

The disclosed CM footer block system has been designed to behave structurally in a direction perpendicular to the longitudinal axis of the wall it supports. In the direction parallel to the length of the wall, the disclosed footer block assembly acts as a flexible, segmentally independent platform, with a degree of continuity provided by the heavy-gauge joint reinforcement mortared in place on top of the footer block twin shear keys. The system depends upon the foundation wall itself to act as a grade beam for the longitudinal spread of varying reactions reflecting non-uniform stress distributions.

It will be appreciated from the foregoing that the prefabricated footing system of the invention provides all of the advantages of prior precast footing systems while eliminating most of the disadvantages and providing additional features and advantages not heretofore feasible in systems of this type. Thus the CM stretcher blocks of the present invention are provided in a size and shape susceptible of ready manual handling and assembly. The modular aspect of the system simultaneously permits architectural and engineering flexibility not previously possible in prior precast footing systems. The shape of the CM stretchers and CM corner blocks constructed according to the invention is simple whereby manufacturing costs are minimized and transportation is convenient and efficient.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A footing system for a structure, said structure being a wall resting upon and extending upwardly from the footing system comprising:

a footing including a plurality of footing blocks disposed in abutting relationship along a footing axis substantially parallel to the structure to be supported on said footing and so that said footing functions as a foundation system for the structure;

said footing blocks having protrusions and depressions in abutting sides thereof to provide a lateral interlocking and alignment between adjacent footing blocks;

said footing blocks having a lateral dimensions substantially perpendicular to said footing axis and longitudinal dimensions along said footing axis wherein said lateral dimensions are substantially larger than said longitudinal dimensions;

whereby said wall is supported on said abutting footing blocks and wherein said wall has a width dimension along said footing axis which is significantly less than the corresponding lateral dimension of said footing blocks, the wide lateral dimension of said footing blocks enabling the footing system to cope with the poor soil conditions while at the same time keeping the weight of the individual footing blocks relatively low to permit efficient manual handling, said footing blocks further enabling the footing to conform to uneveness of the substrate foundation by virtue of the ability of the footing blocks of relatively short longitudinal extent relative to their lateral extent to settle into firm supporting engagement with the substrate, thereby minimizing stresses within the footing which might otherwise result in breakage of the footing and weakening of the wall.

2. A footing system according to claim 1 wherein said lateral dimensions of said blocks are nominal multiples of said longitudinal dimensions of said blocks.

3. A footing system according to claim 2 wherein said lateral dimensions of said blocks are at least four times the longitudinal dimensions of said blocks.

4. A footing system according to claim 1 wherein said blocks have a vertical dimension substantially perpendicular to said footing axis significantly larger than said longitudinal dimension of said blocks along said axis.

5. A footing system according to claim 4 wherein said vertical dimension is at least about twice said longitudinal dimension.

6. A footing system according to claim 4 wherein said lateral dimensions of the blocks are significantly larger than said vertical dimensions of said blocks.

7. A footing system according to claim 6 wherein said lateral dimensions of said blocks are at least about twice said vertical dimensions of said blocks.

8. A footing system according to claim 1 wherein said structure supported by said footing includes concrete masonry blocks supported on said abutting footing blocks and disposed substantially along a central plane of the structure and wherein the dimensions of said masonry blocks on said footing and along said axis are significantly greater than said longitudinal dimensions of said footing blocks.

9. A footing system according to claim 8 wherein said dimensions of said concrete masonry blocks along said plane are at least four times said longitudinal dimensions of said footing blocks.

10. A footing system according to claim 1 wherein each footing block has a horizontal cross sectional shape comprised of a multiplicity of adjoining rectangles offset with respect to one another in a direction parallel to said footing axis to provide said protrusions and depressions.

11. A footing system according to claim 1 wherein said footing blocks are formed with elongated grooves in upper surfaces thereof extending substantially parallel to said footing axis.

12. A concrete wall and foundation system for a building, comprising in combination:

a footing system including a plurality of footing blocks disposed in abutting relationship along a footing axis defining a first row substantially parallel to the concrete wall to be supported on said footing;

said footing blocks having protrusions and depressions in the abutting sides thereof to provide a lateral interlocking and alignment between adjacent blocks;

said footing blocks having a lateral dimensions substantially perpendicular to said footing axis and longitudinal dimensions along said footing axis wherein said lateral dimensions are substantially larger than said longitudinal dimensions; and said concrete wall being supported on said abutting footing blocks and wherein said concrete wall has a width or thickness dimension along said footing axis which is significantly less than the corresponding lateral dimensions of said footing blocks, whereby the wide lateral dimension of said footing blocks enables the footing system to cope with poor soil conditions while at the same time keeping the weight of the individual footing blocks relatively low to permit efficient manual handling, said footing blocks further enabling the footing to conform to inevitable unevenness of the substrate foundation by virtue of the ability of the footing blocks of relatively short longitudinal extent relative to their lateral extent to settle into firm supporting engagement with the substrate, thereby minimizing stresses within the footing which might otherwise result in breakage of the footing and weakening or cracking of the concrete wall.

13. A footing according to claim 12, further including corner blocks having a substantially rectangular cross section containing protrusions and depressions mating with said protrusions and depressions on abutting footing blocks, and further including a second row of said footing blocks disposed in abutting relationship with each other along a second footing axis being substantially perpendicular to the footing axis of the first row of blocks, said corner blocks being disposed in at least two pairs of establish a corner having outer edges substantially coextensive with outer edges of the footing blocks in said first and second rows.

14. A footing according to claim 13 wherein the dimensions of said protrusions and depressions on said corner blocks are related to the dimensions of said protrusions and depressions on the mating footing blocks in such a manner as to provide vertical openings for receiving reinforcing means.

15. A footing according to claim 13 wherein said corner blocks are of substantially cubical shape.

16. A footing system for a structure, said structure being a wall resting upon and extending upwardly form the footing system comprising:

a footing including a plurality of footing blocks disposed in a first row in abutting relationship along a footing axis substantially parallel to the structure to be supporting on said footing and so that said footing functions as a foundation system for the structure;

said footing blocks having protrusions and depressions in abutting sides thereof to provide a lateral interlocking and alignment between adjacent footing blocks;

said footing blocks having lateral dimensions substantially perpendicular to said footing axis and longitudinal dimensions along said footing axis wherein said lateral dimensions are substantially larger than said longitudinal dimensions:

whereby said wall is supported on said abutting footing blocks and wherein said wall has a width dimension along said footing axis which is significantly less than the corresponding lateral dimensions of said footing blocks, the wide lateral dimension of said footing blocks enabling the footing system to cope with poor soil conditions while at the same time keeping the weight of the individual footing blocks relatively low to permit efficient manual handling, said footing blocks further enabling the footing to conform to inevitable unevenness of the substrate foundation by virtue of the ability of the footing blocks of relatively short longitudinal extent relative to the their lateral extent to settle into firm supporting engagement with the substrate, thereby minimizing stresses within the footing which might otherwise result in breakage of the footing and weakening of the wall, further including corner blocks having a substantially rectangular cross section containing protrusions and depressions mating with said protrusions and depressions on abutting footing blocks, and further including a second row of said footing blocks disposed in abutting relationship with each other along a second footing axis being substantially perpendicular to the footing axis of the first row of blocks, said corner blocks being disposed in at least two pairs to establish a corner having outer edges substantially coextensive with outer edges of the footing blocks in said first and second rows.

* * * * *